US007137798B2

(12) United States Patent
Götschhofer

(10) Patent No.: US 7,137,798 B2
(45) Date of Patent: Nov. 21, 2006

(54) GEAR PUMP WITH VARIABLE THROUGHPUT VOLUME

(75) Inventor: Alfred Götschhofer, Molln (AT)

(73) Assignee: TCG Unitech Systemtechnik GmbH, Micheldorf (AT)

( * ) Notice: Subject to any disclaimer, the term of this patent is extended or adjusted under 35 U.S.C. 154(b) by 305 days.

(21) Appl. No.: 10/809,907

(22) Filed: Mar. 26, 2004

(65) Prior Publication Data

US 2004/0191103 A1 Sep. 30, 2004

(30) Foreign Application Priority Data

Mar. 28, 2003 (AT) ..... A 493/2003

(51) Int. Cl.
*F01C 1/18* (2006.01)

(52) U.S. Cl. ..... 418/206.1; 418/21

(58) Field of Classification Search ..... 418/206.1, 418/21, 133, 270, DIG. 1
See application file for complete search history.

(56) References Cited

U.S. PATENT DOCUMENTS 2,052,419 A * 8/1936 Moore et al. ..... 418/21
3,110,265 A * 11/1963 Miller ..... 418/21
4,740,142 A * 4/1988 Rohs et al. ..... 418/21
4,872,536 A * 10/1989 Yue ..... 188/290
5,306,127 A * 4/1994 Kinney ..... 418/21
5,724,812 A * 3/1998 Baker ..... 60/490
6,244,839 B1 * 6/2001 Cole et al. ..... 418/21
6,283,735 B1 * 9/2001 Schreiber et al. ..... 418/21

FOREIGN PATENT DOCUMENTS

| | | |
|---|---|---|
| AT | 003767 | 7/2000 |
| DE | 4121074 | 1/1993 |
| DE | 19631956 | 2/1998 |
| DE | 19924057 | 11/2000 |
| GB | 2265945 | 10/1993 |
| RU | 2177085 | 12/2001 |

* cited by examiner

*Primary Examiner*—Hoang Nguyen
(74) *Attorney, Agent, or Firm*—Dykema Gossett PLLC

(57) ABSTRACT

In a gear pump with variable throughput volume, with two meshed gears with external toothing which are rotatably held in the working chamber of a pump housing, at least one of the two gears is driven from a drive shaft and one of the gears, preferably the driven gear, is shiftable in the direction of its axis. In order to realize a control mechanism in a simple manner a gap width defined as the distance measured in axial direction between an essentially plane first interior side wall of the working chamber of the pump housing and a first front face of the shiftable gear, is designed to be variable.

26 Claims, 3 Drawing Sheets

GEAR PUMP WITH VARIABLE THROUGHPUT VOLUME

BACKGROUND OF THE INVENTION

The invention relates to a gear pump with variable throughput volume furnished with two meshed gears with external toothing, which are rotatably held in the working chamber of a pump housing, where at least one of the two gears can be driven by a drive shaft and where one of the two gears, preferably the driven gear, can be shifted in the direction of its axis.

Conventional gear pumps with two meshing external gears have a driving gear which is driven from a drive shaft and is driving the second gear. Besides the tooth profile and the number of revolutions per minute of the pump the meshing width determines the throughput volume of the gear pump. Losses, which occur due to the clearance between the gear tips and the pump housing and due to the play allowed for the gap at the front faces of the gears, will affect the efficiency of the gear pump. Gear pumps of this kind are usually employed as oil pumps in internal combustion engines. Conventional oil pumps are coupled to the engine crankshaft at a fixed speed ratio by rigid, non-variable coupling means such as chains, toothed belts or toothed wheels. As engine speed increases the rpm of the oil pump will also increase and thus also the throughput of the pump. Oil pumps are usually designed to guarantee oil supply of the internal combustion engine in the worst case over the total speed range, that is at idling speed with the largest gap cross-section in the bearings, taking into account all additional oil consumers of the engine such as pistons, spray nozzles for piston cooling, turbochargers, etc. Given this design it follows that at higher engine speeds the oil pump will supply an oil volume which is many times greater than that actually required at higher engine speeds. Adapting the oil volume to the amount actually needed in a given engine state is conventionally done by pressure control and discharge of the superfluous amount of oil into the oil sump, or by recirculating the oil into the input passage of the pump. Since the gears of the pump will constantly deliver the maximum volume of oil they constantly require the same high input of driving power, independently of the actually needed output volume. This will have a disadvantageous effect on the efficiency.

DESCRIPTION OF PRIOR ART

From DE 196 31 956 A1 a gear pump with adjustable displacement volume is known. One of the gears of the pump is provided with passages extending from a coaxial bore to the bottom of the spaces between the teeth. The bore contains a rotary valve with at least one web having a partially cylindrical wall and bounding an axial recess of the rotary valve. The valve is non-rotatingly held on the shaft carrying the gear. The wall of the web rests against the inside of the bore and the recess is connected to the low pressure side of the pump. By adjusting the rotary valve the displacement volume of the pump may be adjusted depending on the open cross-section of the passages. The adjustment mechanism is relatively complex and consists of many intricately shaped parts.

It is furthermore known to adjust the throughput volume of a gear pump by changing the meshing width of the gears. In this case at least one of the gears may be shifted in axial direction thus changing the meshing width, which may necessitate the use of filling parts entering between the teeth in order to avoid dead space. Gear pumps of this type are known for instance from GB 2 265 945 A, AT 003 767 U1, DE 41 21 074 A1, or RU 2 177 085 C. In addition to the great number of parts required by this design a further disadvantage lies in the fact that the axial shifting of the gears necessitates a relatively large axial dimension of the device.

DE 19 924 057 A1 describes a gear mechanism with two meshing gears onto whose side faces axially shiftable parts are pressed in order to achieve axial sealing. The two parts are subjected in axial direction to different resulting forces and pressed against the gears, which are thereby shifted in axial direction into a defined position. This should avoid a widened inlet track in the housing.

SUMMARY OF THE INVENTION

It is the object of the present invention to avoid the above disadvantages and to achieve control of the throughput volume of a gear-type pump as described above, in as simple a manner as possible.

To achieve this aim it is provided by the invention that a gap-width defined by the distance measured in axial direction between an essentially plane first interior side wall of the working chamber of the pump housing and a first front face of the shiftable gear be adjustable. Preferably, the gap-width should be variable in a range between 0 and d/5, and preferably between 0 and d/50, where d is the exterior diameter of the shiftable gear.

In contrast to known controllable gear pumps with axially adjustable gears, control of the throughput volume is achieved in this case by changing the gap-width and thus the gap losses. No filling parts entering the spaces between the teeth to avoid dead space will be required. Since the gap-width exerts a strong influence on pressure and throughput volume of the gear pump, only very small axial shifts will be necessary to control pressure and throughput volume via changes in the gap-width.

In order to permit a lateral movement of the shiftable gear in a simple manner it is provided that a second plane interior side wall of the working chamber parallel to and opposite of the first interior side wall be furnished with an essentially cylindrical recess concentric with the axis of the gear and situated in the area of the second front face of the shiftable gear facing away from the first front face, the diameter of the recess being larger than the outer diameter of the gear, at least in the area of the shiftable gear.

It is of particular advantage if a preferably disk-shaped sealing plate is placed in the area of the recess, which plate separates the working chamber of the pump housing from the dead space inside the recess, the sealing plate being preferably fixedly attached to the shiftable gear. The preferably disk-shaped sealing plate will effect a lateral seal against the dead space. In order to avoid pressure peaks it is further provided that the sealing plate have radial relief grooves on the side facing the second front face of the gear, which are positioned such that each space between the teeth of the shiftable gear corresponds to at least one relief groove. It is particularly advantageous if an outlet groove is located in the second interior side wall of the working chamber opposite the first interior side wall on the pressure side of the gears, i.e. on the side where the sealing plate is located, which outlet groove should be positioned in such a way that each relief groove communicates at least once with the outlet groove during each revolution of the sealing plate. Pressure peaks can be avoided, in particular when the gears are in their initial unshifted position in which they mesh over their whole width, by means of the relief grooves and the excess oil outlet groove. At higher engine speeds and large gap widths pressure pulsations can also be compensated by the ensuing gap space.

In the gear pump described here pressure and volume control are achieved wholly without control plungers or valves, which will permit a very compact design. Since controlling is effected by varying the gap losses and reduced suction/pressure performance is required in the control range, the gear pump's power consumption is greatly reduced in the control range. Due to the very small lateral displacement of the gears the load on the teeth is distributed over almost their whole width, which results in substantially reduced wear as compared to conventional pumps controlled via the meshing width.

In a very advantageous variant of the invention it is provided that a leakage channel departs from the dead space, this channel being preferably configured as a helical groove in the pump housing adjacent to the control shaft. Oil leaking into the dead space from between the sealing plate and the pump housing may thus be reliably removed.

In order to avoid pressure peaks in the dead space and to reliably guarantee pressure relief, a preferred variant of the invention provides that the dead space be flow-connected via a relief passage with a pressure sink, preferably with the suction side of the pump or the pump environment, the relief passage being preferably furnished with a pressure relief valve, which opens in the direction of the pressure sink. The pressure relief valve is designed to prevent any pressure increase in the dead space. A malfunction of the control mechanism of the gear pump can thus be avoided, which is of particular importance during cold-start and when the sealing plate is radially closed.

According to a particularly advantageous variant the sealing plate has at least one sealing groove in its side wall, which groove extends along the entire circumference. If such a sealing groove is provided radial relief grooves may be dispensed with.

Shifting of the gear may be achieved in a simple manner by rigidly mounting the gear, and preferably also the sealing plate, on a control shaft which rotates in the pump housing and can be shifted in the direction of its axis. In a particularly preferred variant it is provided that the control shaft be furnished with at least one pressure plunger to effect the axial shift, which plunger cooperates with a pressure chamber containing a pressure medium, where preferably the pressure medium is identical with the medium to be pumped and where the pressure chamber is flow-connected with the pressure side of the gear pump. Alternatively the pressure chamber may be connected with an external pressure source or a clean-oil control device. This will permit external control. A restoring spring, configured for instance as a compression spring, may be used to reposition the control shaft. In an alternative variant it could be provided that the control shaft be moved, at least in one direction, by an electric motor.

BRIEF DESCRIPTION OF THE DRAWINGS

The invention will now be further described with reference to the enclosed drawings, wherein.

Functionally identical parts bear the same reference numbers in all variants.

DETAILED DESCRIPTION OF THE PREFERRED EMBODIMENTS

Figure 1:
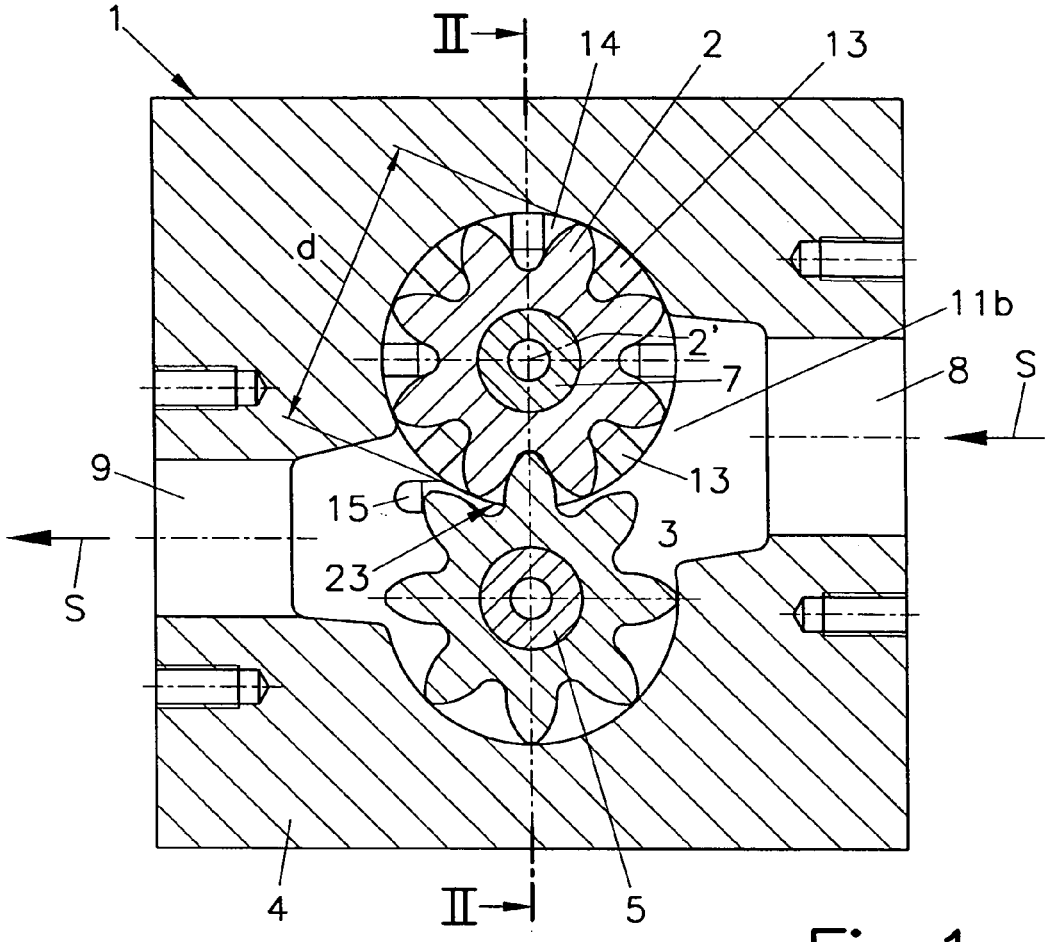
FIG. 1 shows a gear pump according to the invention in a section along line I—I in FIG. 2.

The gear pump 1 has two externally toothed meshing gears 2, 3 which are rotatably held in the working chamber 11 of a pump housing 4. The gear 3 is driven by a drive shaft 5 and in turn drives the gear 2. The driven gear 2 is mounted, together with a sealing plate 6, on a control shaft 7 and can be shifted in the direction of the axis 2' of the gear 2 together with the shaft 7, as indicated by the arrow P. Reference number 8 indicates the suction side, reference number 9 the pressure side of the gear pump 1 and the arrows S show the flow direction of the medium.

Figure 2:
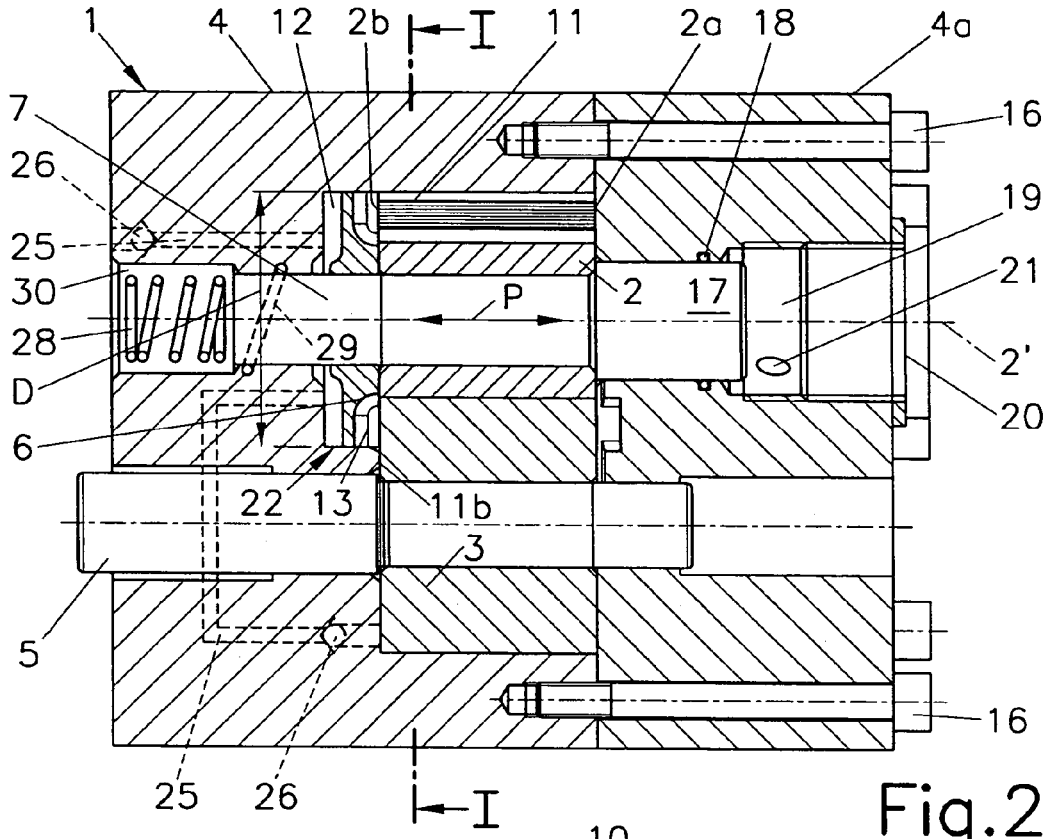
FIG. 2 shows the gear pump in a section along line II—II in FIG. 1, in the rest position, in a first variant of the invention.
Figure 3:
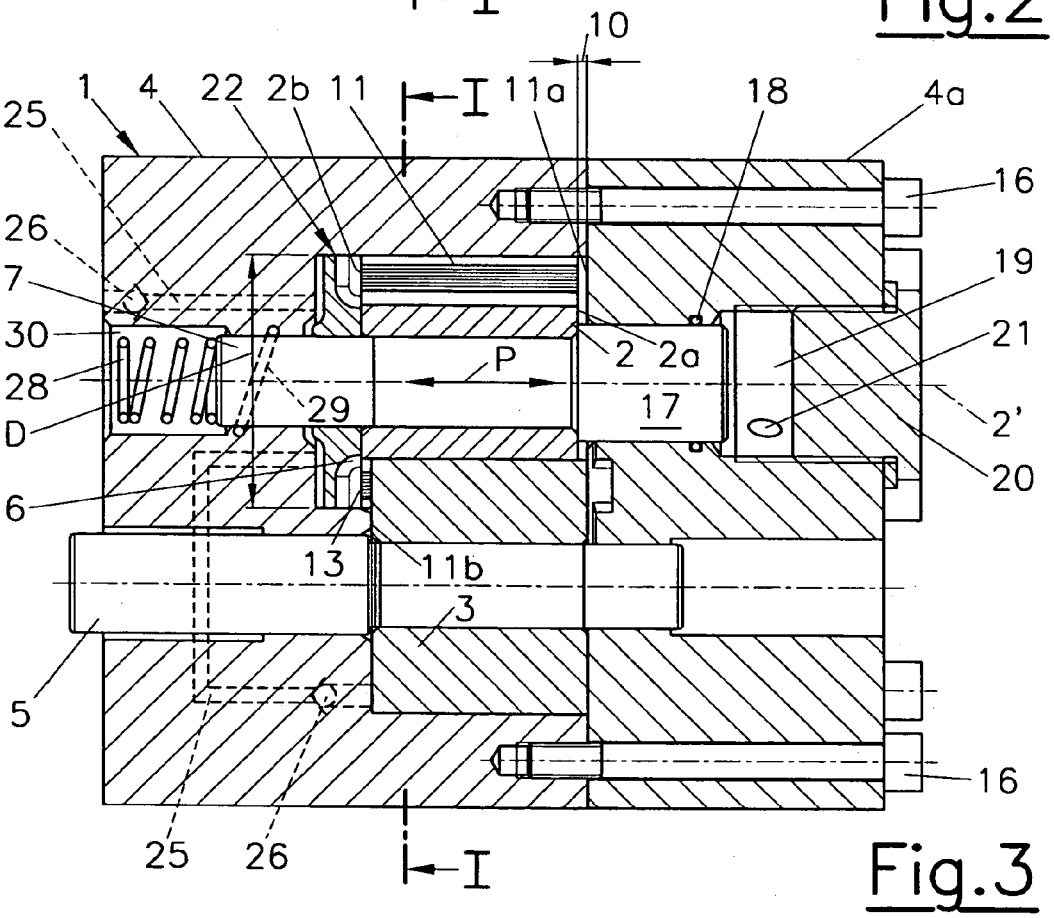
FIG. 3 shows the gear pump of this variant in a section along line II—II in FIG. 1, in a control position.

By shifting the control shaft 7 and thus the shiftable gear 2 the gap-width 10 as shown in FIG. 3 may be altered. The gap-width 10 is defined as the distance between a plane first interior side wall 11*a* of the working chamber 11 of the pump housing 4 and a first front face 2*a* of the shiftable gear 2. With d denoting the outer diameter of the gear 2, the range of adjustment of the gap-width 10 is between 0 and d/5, and preferably between 0 and d/50, with a minimum value of the gap-width 10 due to manufacturing tolerances, corresponding to the initial (i.e. unshifted) state shown in FIG. 2.

Control of the pressure, respectively the throughput volume, is achieved by altering the gap-width 10 and thus the gap losses. In this way no filling parts to fill the spaces 14 between the teeth will be needed. A small shift of the shiftable gear 2 will be sufficient to alter the gap-width 10 to the degree required.

In order to permit a lateral movement of the gear 2, the second interior side wall 11*b* opposite of the first interior side wall 11*a*, is furnished with an essentially cylindrical recess 22 concentric with the axis 2', whose diameter D in the area of the second front face 2*b* of the shiftable gear 2, is larger than the outer diameter d of the gear 2.

The disk-shaped or annular sealing plate 6 located in the recess 22 serves to seal the working chamber 11 containing the gears 2, 3 against the dead space 12 in the recess 22, which is required for the shifting of the gear 2. In order to avoid pressure increase in the dead space 12 the latter is connected via a relief passage 25 indicated by dashed lines in FIGS. 2 and 3, respectively FIGS. 4 and 5, to a pressure sink, which may be the suction chamber 8 or the pump environment, for instance the oil sump. A pressure relief valve 26 is located in the relief passage 25 which opens in the direction of the pressure sink. The sealing plate 6 is provided with radial relief grooves 13 on the side facing the second front face 2*b* opposite the first front face 2*a* of the shiftable gear 2. The relief grooves 13 are positioned in the symmetry axis of the spaces between the teeth of gear 2.

Each radial relief groove 13 is positioned in the area of a space 14 between the teeth of the shiftable gear 2 and communicates during a revolution of the gear 2 with an outlet groove 15 which is formed in the pump housing 4 in the pressure-side meshing area 23 of the two gears 2, 3. The relief grooves 13 and the outlet groove 15 serve to avoid pressure peaks, especially at low speed in the initial state of the gear pump 1 when control is not active.

Figure 6:
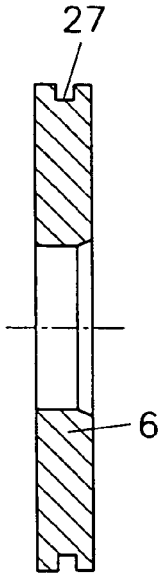
FIG. 6 shows the sealing plate of an alternative variant of the invention in a sectional view.

If, as shown in FIG. 6, the sealing plate 6 is provided in its side wall with at least one sealing groove 27 extending along the entire circumference, the relief grooves 13 may be dispensed with, since the sealing groove 27 acts as a labyrinth seal and compensates pressure peaks.

Reference number 4*a* indicates a pump housing cover held by screws 16 on the pump housing 4.

The leakage groove indicated by reference number 29 serves to remove oil leaking into the dead space 12 through the annular gap between sealing plate 6 and pump housing 4. The leakage groove 29 is for instance configured as a helical groove connecting the dead space 12 with a spring chamber 30. In order to reliably remove leakages during normal operation the sum of the cross-section areas of the leakage groove 29 and the bearing clearance of the control shaft 7 must at least equal the area of the annular gap between sealing plate 6 and pump housing 4.

Figure 4:
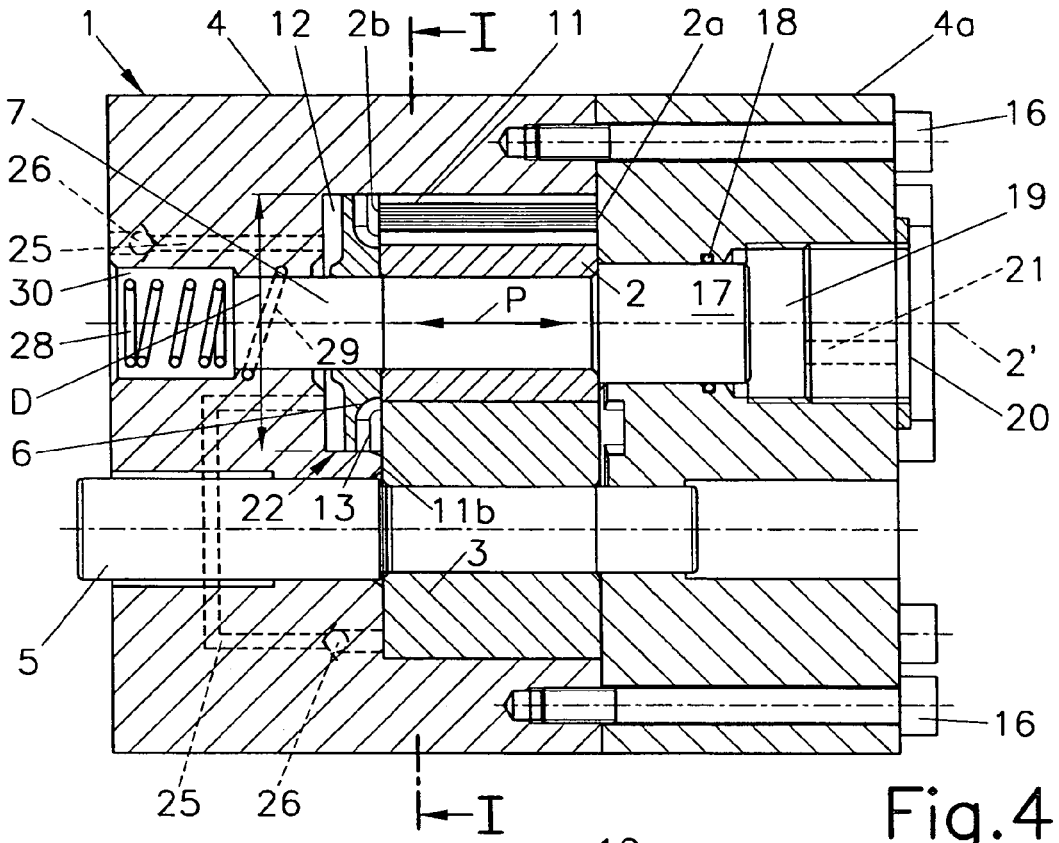
FIG. 4 and FIG. 5 show the gear pump in a second variant of the invention, in analogy to FIGS. 2 and 3.
Figure 5:
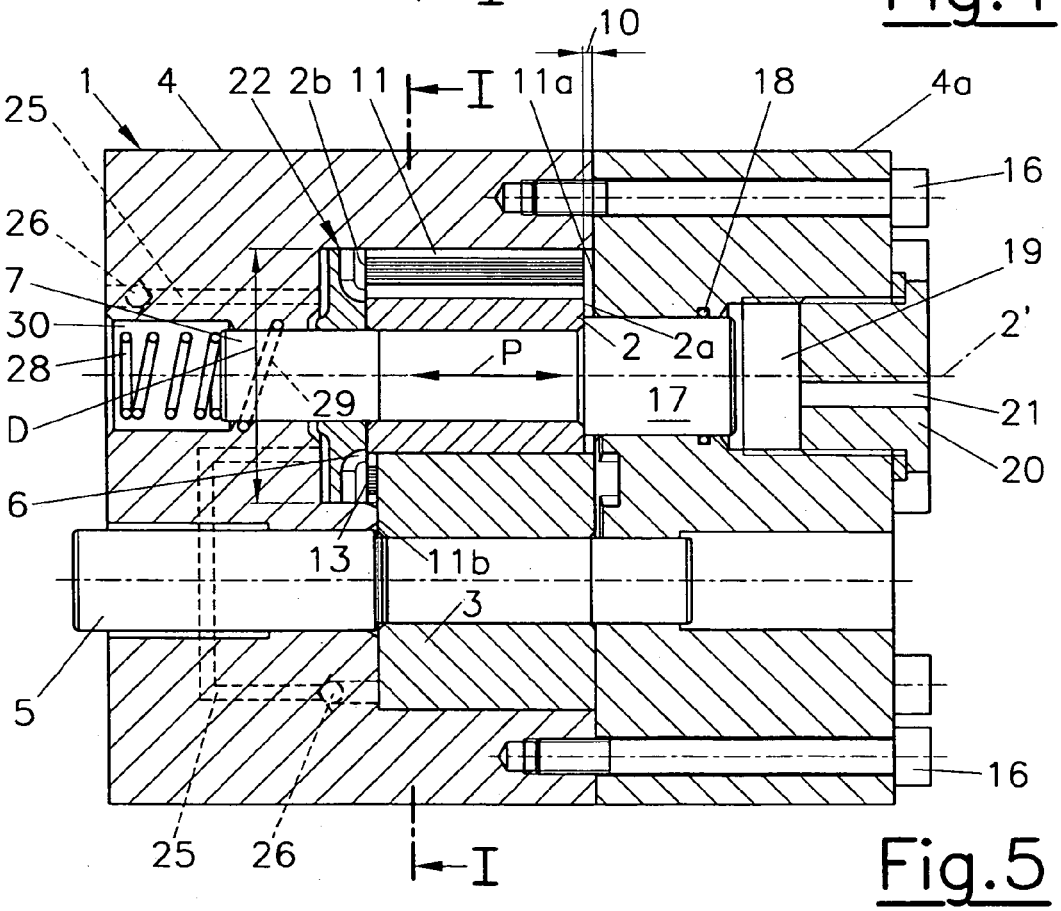

The control shaft 7 is furnished with a pressure plunger 17, which is sealed against the pump housing cover 4*a* by a sealing ring 18. The plunger 17 enters a pressure chamber 19, which is closed by a screw 20. Into the pressure chamber 19 opens an inlet for pressurized oil 21, which is either flow-connected with the pressure side 9 of the gear pump 1 (FIGS. 2 and 3) or connected to an external pressure source or a clean-oil control device (pressurized oil is supplied behind the oil filter) (FIGS. 4 and 5). Thus the displacement of the control shaft 7 to the control position is determined by the pumping pressure of the gear pump 1. Repositioning to the rest position is effected by a restoring spring 28, e.g. a compression spring, located in a spring chamber 30, or by an electric motor. If desired the shifting of the control shaft 7 to the control position could also be effected by an electric motor instead of the pump pressure.

What is claimed is:

1. Gear pump with variable throughput volume which comprises a housing defining a working chamber, two meshing gears with external toothing rotatably mounted in the working chamber of the housing, at least one of the two gears being driven from a drive shaft and one of the two gears being shiftable in the direction of an axis thereof, wherein a gap-width, which defined as a free space between an essentially plane first interior side wall of the working chamber of the housing and a first front face of the shiftable gear, is variable.

2. Gear pump according to claim 1, wherein a driven gear is shiftable in the direction of its axis.

3. Gear pump according to claim 1, wherein the gap-width is variable in a range between 0 and d/5, d being an outer diameter of the shiftable gear.

4. Gear pump according to claim 3, wherein the gap-width is variable in a range between 0 and d/50.

5. Gear pump according to claim 1, wherein a second plane interior side wall of the working chamber parallel to and opposite of the first interior side wall is furnished with an essentially cylindrical recess concentric with the gear axis and situated in an area of a second front face of the shiftable gear facing away from the first front face, the diameter of said recess being larger that the outer diameter d of the gear, at least in an area of the shiftable gear.

6. Gear pump according to claim, 5, wherein a sealing plate is placed in an area of the recess, which plate separates the working chamber of the pump housing from a dead space inside the recess.

7. Gear pump according to claim 6, wherein the sealing plate is configured disk-shaped.

8. Gear pump according to claim 6, wherein the sealing plate is being fixedly attached to the shiftable gear.

9. Gear pump according to claim 6, wherein the sealing plate has radial relief grooves on the side facing the second front face of the shiftable gear, which are positioned such that each space between the teeth of the shiftable gear corresponds to at least one relief groove.

10. Gear pump according to claim 9, wherein an outlet groove is located in the second interior side wall of the working chamber opposite the first interior side wall in the meshing area of the gears on the pressure side, i.e., on the side where the sealing plate is located, which outlet groove is positioned in such a way that each relief groove communicates at least once with the outlet groove during each revolution of the sealing plate.

11. Gear pump according to claim 6, wherein the dead space is flow-connected via a relief passage with a pressure sink.

12. Gear pump according to claim 11, wherein the dead center is flow-connected via the relief passage to a suction side of the pump.

13. Gear pump according to claim 11, wherein the dead center is flow-connected via the relief passage to a pump environment.

14. Gear pump according to claim 11, wherein the relief passage is furnished with a pressure relief valve opening in the direction of the pressure sink.

15. Gear pump according to claim 6, wherein the sealing plate has at least one sealing groove in its side wall, which groove extends along an entire circumference.

16. Gear pump according to claim 1, wherein a leakage channel departs from the dead space.

17. Gear pump according to claim 16, wherein the leakage channel is configured as a groove in the pump housing adjacent to the control shaft.

18. Gear pump according to claim 17, wherein the groove is shaped helically.

19. Gear pump according to claim 16, wherein the control shaft is shifted, at least in one direction, by an electric motor.

20. Gear pump according to claim 1, wherein the shiftable gear is rigidly mounted on a control shaft which rotates in the pump housing and can be shifted in the direction of axis.

21. Gear pump according to claim 20, wherein the sealing plate is rigidly mounted on the control shaft.

22. Gear pump according to claim 20, wherein the control shaft is furnished with at least one pressure plunger to effect the axial shift, which plunger cooperates with a pressure chamber containing a pressure medium.

23. Gear pump according to claim 22, wherein the pressure medium is identical with the medium to be pumped and the pressure chamber is flow-connected to the pressure side of the gear pump.

24. Gear pump according to claim 22, wherein the pressure chamber is connected with an external pressure source.

25. Gear pump according to claim 22, wherein the pressure chamber is connected with a clean-oil control device.

26. Gear pump according to claim 22, wherein a restoring spring acts on the control shaft thus counteracting displacement by the pressure plunger.

* * * * *